US005298723A

United States Patent [19]

Philpot

[11] Patent Number: 5,298,723

[45] Date of Patent: Mar. 29, 1994

[54] HEATER ELEMENT SUPPORT ASSEMBLY

[75] Inventor: James E. Philpot, Cookeville, Tenn.

[73] Assignee: Teledyne Industries Inc., Cookeville, Tenn.

[21] Appl. No.: 907,542

[22] Filed: Jul. 2, 1992

[51] Int. Cl.[5] ..... H05B 3/06; H01C 3/10; H01C 3/14; H01C 7/22

[52] U.S. Cl. ..... 219/532; 219/536; 219/546; 219/541; 338/290; 338/304

[58] Field of Search ..... 219/536, 541, 544, 546, 219/532; 338/290, 304; 361/417, 419, 426; 174/166 R, 164; 248/27.1

[56] References Cited

U.S. PATENT DOCUMENTS

| | | | |
|---|---|---|---|
| 2,979,554 | 4/1961 | Maitland | 174/138.6 |
| 3,049,585 | 8/1962 | Cochran | 174/166 R |
| 3,943,333 | 3/1976 | Kokjohn et al. | 219/532 |
| 3,963,859 | 6/1976 | Peterson | 219/532 |
| 4,209,686 | 6/1980 | Moglia | 219/536 |
| 4,250,399 | 2/1981 | King | 219/532 |
| 4,268,742 | 5/1981 | Cottrell | 219/532 |
| 4,472,624 | 9/1984 | Janning | 219/532 |
| 4,531,017 | 7/1985 | Sherrill | 219/532 |
| 4,628,189 | 12/1986 | Danko | 219/532 |
| 4,692,599 | 9/1987 | Howard et al. | 219/532 |

*Primary Examiner*—Bruce A. Reynolds
*Assistant Examiner*—Michael D. Switzer
*Attorney, Agent, or Firm*—Dennison, Meserole, Pollack & Scheiner

[57] ABSTRACT

A support assembly for an open coil heating element including a planar mounting plate having longitudinally spaced and offset cutouts therethrough with a separate insulator positioned within each cutout by sequentially introducing the insulator through the cutout and longitudinally shifting the insulator within the cutout to overlie the upper and lower surfaces of the mounting plate. The two insulators are locked within their mounted positions within the cutouts by a locking frame affixed to the mounting plate and abutting against the insulators to preclude movement of the insulators from their mounted positions.

13 Claims, 3 Drawing Sheets

FIG. 1
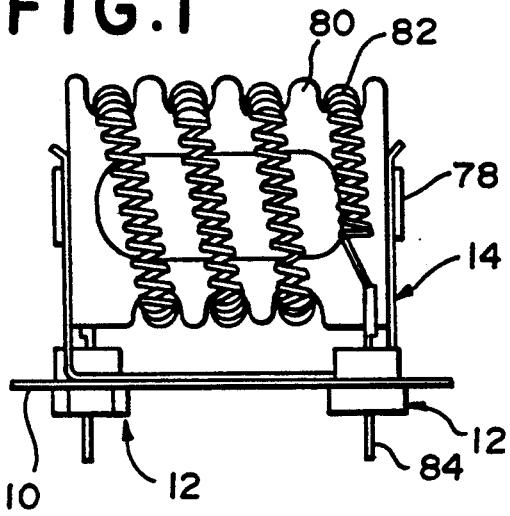
FIG. 2
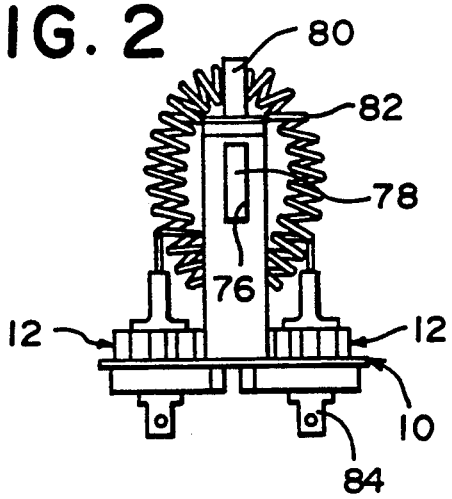
FIG. 3
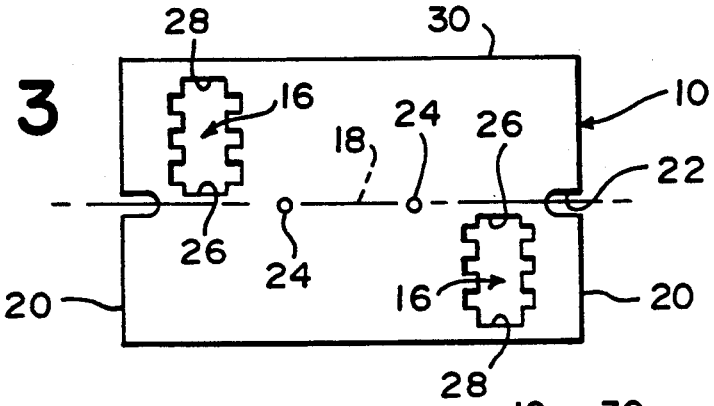
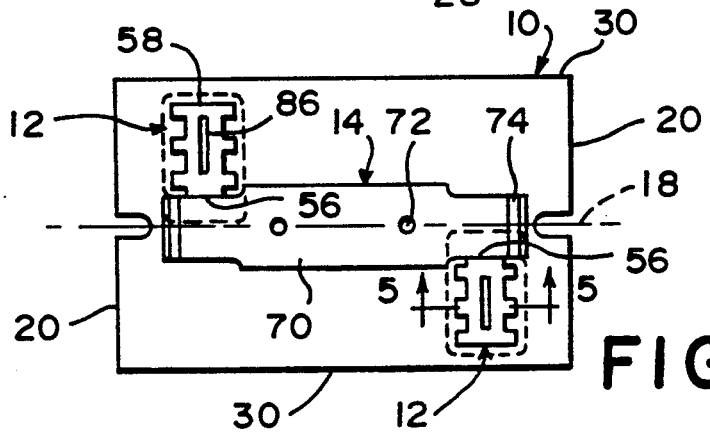
FIG. 4
FIG. 5
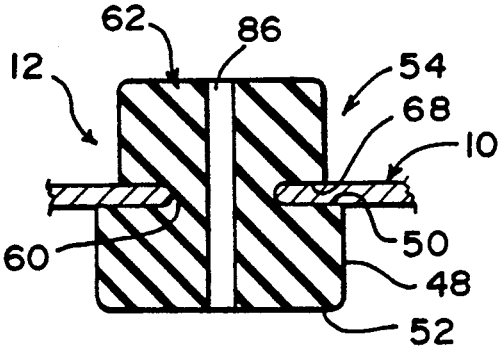

HEATER ELEMENT SUPPORT ASSEMBLY

BACKGROUND OF THE INVENTION

Electric coil heating elements for use in different types of appliances for the selective heating of air are well known.

The support assemblies for such coils, while taking many forms, normally include a metallic base member with electrical insulating means for supporting the coil and accommodating the opposed end terminals of the coil.

One known assembly, utilized in the dryer of dishwashers and mounted within the plenum chamber with a motorized fan, comprises a flat metal mounting plate with a pair of spaced rectangular apertures therethrough. A two part insulator is mounted at each aperture and includes separate upper and lower parts which seat respectively on the upper and lower faces of the plate. The two parts are joined together through the aperture and retained in clamped engagement with the plate by an elongate terminal screw. The coil itself is supported in spaced overlying relation to the plate by a ceramic support comb which in turn mounts to an upstanding frame. The opposed ends of the coil align with the two insulators and extend therethrough for connection to an appropriate source of electrical energy.

SUMMARY OF THE INVENTION

The present invention is specifically concerned with an improved support assembly for the heating element of a dishwasher dryer of the general type above described. The improved assembly results in a significant reduction in the number of individual parts utilized, a reduction in the labor required for assembly, and a reduction in the assembly time.

The advantages of the invention are derived from several factors including the formation of each insulator as a single unit, the specific configuration of the insulators and plate apertures to allow for a mounting of the insulators through a simple insertion and slide positioning thereof, and the utilization of the coil-positioning frame as a means for simultaneously retaining the insulators locked in their mounted position.

The insulators are of an appropriate electrical insulative material such as a ceramic, with each insulator comprising a generally rectangular base with an overlying generally rectangular body integral with the base and peripherally inwardly offset from the outer periphery of the base. The body includes a central elongate neck or neck portion extending from the base for a height only slightly greater than the thickness of the mounting plate to which the insulator is to be secured, and a head or head portion defined immediately above the neck. The head, along the opposed longitudinal edges thereof, is formed with opposed pairs of outwardly projecting extensions or arms defining notches therebetween. The insulator also includes a central slot therethrough for the full height thereof.

The mounting plate is provided with a cutout to receive each insulator, normally two cutouts being provided for the reception of two insulators. Each cutout has the opposed longitudinal edges thereof formed with alternating projections or shoulders with edge recesses defined therebetween which complement and allow passage therethrough of the head, and in particular the arms defined along the opposed edges of the head of the insulator.

The enlarged base of the insulator limits the extent of insertion of the insulator through the corresponding cutout with the neck of the insulator positioned within the cutout while the base and head of the insulator are respectively below and above the mounting plate.

The insulator receiving cutout is of a length greater than that of the body, including the neck and head, whereby, subsequent to introduction of the head through the cutout, the insulator is longitudinally shifted to position the insulator arms in directly overlying relation to adjoining pairs of cutout projections, thereby mounting the insulator and precluding a direct removal of the insulator from its mounted position. It will be appreciated that the distance between the base and head of the insulator, defined by the neck, is such so as to allow for a sliding movement of the insulator without excess play therebetween whereby a stable positioning of the insulator is achieved.

Once moved into their mounted positions, the two insulators, spaced to the opposite sides of a longitudinal centerline of the mounting plate, are fixed or locked into position by a mounting frame extending longitudinally along the plate between the insulators and engaged with the insulators to preclude a longitudinal shifting of the insulators in their respective cutouts to the initial insertion position. The frame is in turn permanently affixed, as by rivets, to the mounting plate, after which the coil and support comb therefor are mounted to the frame and the terminal ends thereof engaged through the insulator slots.

Other features and objects of the invention will become apparent from the following more detailed description of the invention.

BRIEF DESCRIPTION OF THE DRAWINGS

FIG. 1 is a side elevational view of the support assembly of the invention with a mounted heating coil;

FIG. 2 is an end elevational view of the assembly;

FIG. 3 is top plan view of the mounting plate;

FIG. 4 is a top plan view of the mounting plate with the insulators mounted and locked thereto;

FIG. 5 is an enlarged cross section view through a mounted insulator and taken on line 5—5 in FIG. 4;

DESCRIPTION OF PREFERRED EMBODIMENTS

Figure 6:
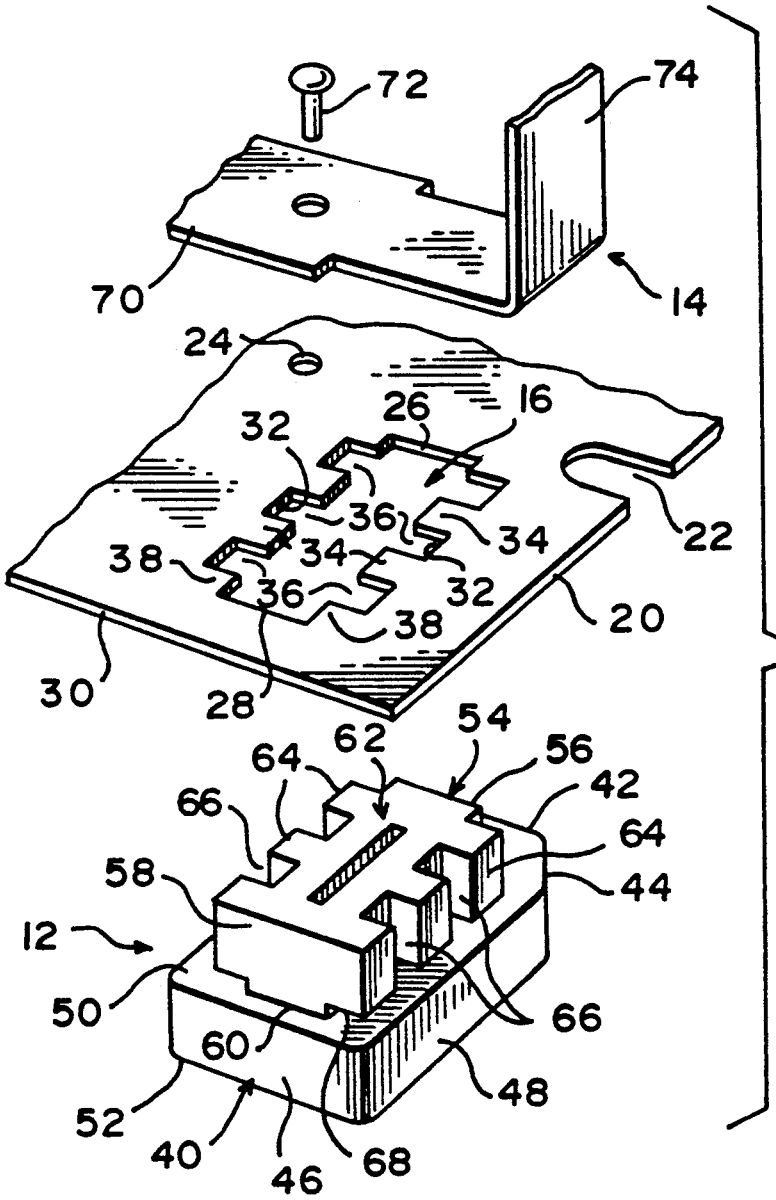
FIG. 6 is a perspective illustration of an insulator and a corresponding plate cutout prior to assembly of the insulator.

Referring now more specifically to the drawings, the support assembly of the invention comprises a metal mounting plate 10, preferably of galvanized aluminum or galvanized steel, a pair of insulators 12 of electrical insulative material such as a ceramic, and a metal positioning frame 14, also preferably of galvanized aluminum or galvanized steel.

The mounting plate 10 is rectangular with a pair of cutouts 16 spaced to the opposite sides of the longitudinal centerline 18 of the plate and in closely spaced relation to the opposed transverse ends 20 of the plate. The plate further includes a pair of mounting notches 22 extending inwardly from the opposed ends 20 on the centerline 18, and a pair of spaced centrally positioned rivet holes 24 also on the centerline.

Each of the cutouts 16 is elongate perpendicular to the longitudinal centerline 18 of the plate 10 and includes a straight inner end 26 parallel to and closely spaced from the centerline 18, and a remote outer end 28 parallel to end 26 and in close inwardly spaced relation to the longitudinal edge 30 of the plate 10.

The opposed side or side edges 32 of each cutout 16 are formed with longitudinally spaced projections or shoulders 34 alternating with edge recesses 36 therebetween. Two such projections 34 and three such recesses 36 are provided along each cutout edge 32 with the corresponding projections and recesses of the two cutout edges 32 being in transverse alignment whereby alternating wider and narrower portions or areas are provided along the length of the cutout 16.

From the outer end 28 of each cutout 16, the first opposed pair of edge recesses 36 are longitudinally inwardly spaced to define a pair of corner projections or shoulders 38 which approximate the shoulders or projections 34 in length and width. Similarly, the opposed pair of edge recesses 36 adjacent the end 26 are also, to a lesser degree, slightly longitudinally offset from the end 26.

The insulators 12, one mounting in each of the cutouts 16, are one piece elements of ceramic electrical insulative material or the like. Each insulator 12 includes a substantially rectangular base 40 elongate between an inner end 42 with chamfered corners 44 and a flat outer end 46. The base 40 has opposed parallel side edges 48 and flat upper and lower surfaces 50 and 52 respectively.

The insulator 12 further includes an elongate body 54 integral with the base and projecting centrally upward from the upper surface 50 thereof. The body 54 includes inner and outer flat ends 56 and 58 respectively inwardly spaced from the inner and outer ends 42 and 46 of the base 40. The body 54 consists of a neck or neck portion 60 and a head or head portion 62. The head 62 is vertically spaced above the upper surface 50 of the base 40 a distance minimally greater than the thickness of the mounting plate 10 and includes integral outwardly extending arms 64 at spaced points along the opposed longitudinal edges thereof. The arms 64 are provided in transversely aligned pairs with three arms 64 along each edge defining notches 66 therebetween. The projecting arms include planar undersurfaces 68 which parallel the upper surface 50 of the base 40 with the space therebetween accommodating the mounting plate as shall be described subsequently.

The size and spacing of the insulator arms 64 and notches 66 complement the recesses 32 and projections 34 of a cutout 16 for free passage upward through the cutout 16 from the undersurface of the mounting plate 10. The base 40 is of a size which precludes passage through the cutout 16 and, upon engagement with the undersurface of the mounting plate 10, positions the insulator 12 with the head 62 thereof immediately above the upper surface of the mounting plate 10.

Figure 7:
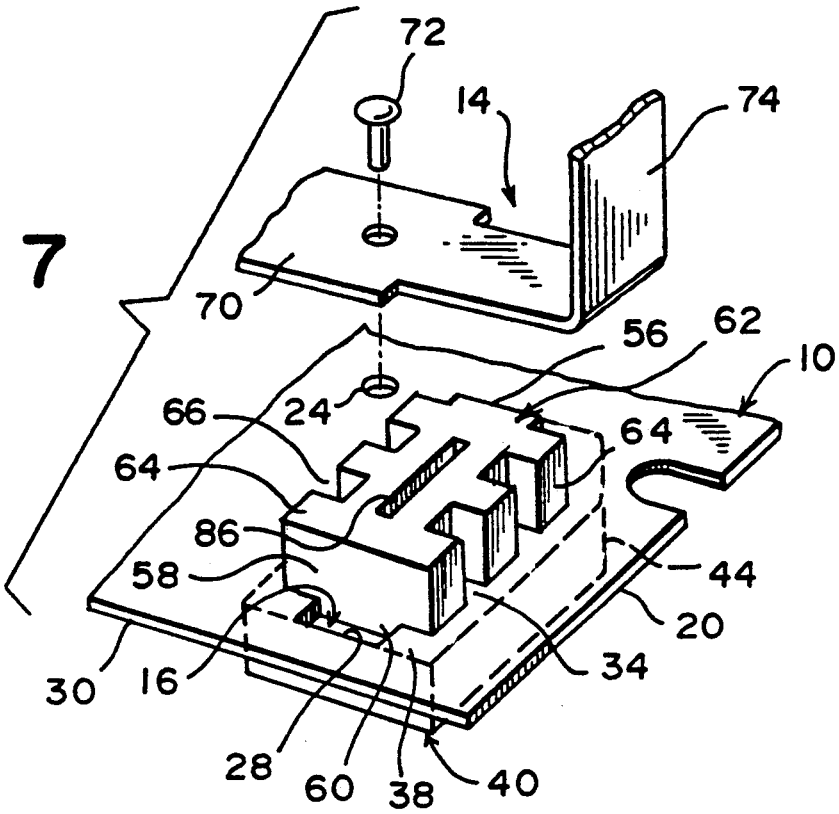
FIG. 7 is a perspective detail of the insulator positioned through the plate cutout.

As will be appreciated from FIG. 7, which illustrates the insulator with the head 62 engaged through the cutout, the head 62, between the ends 56 and 58 thereof, is shorter than the length of the cutout 16 with the end 28 of the cutout positioned longitudinally beyond the outer end 58 of the body upon an alignment of the head 62 with the cutout for vertical passage therethrough.

Figure 8:
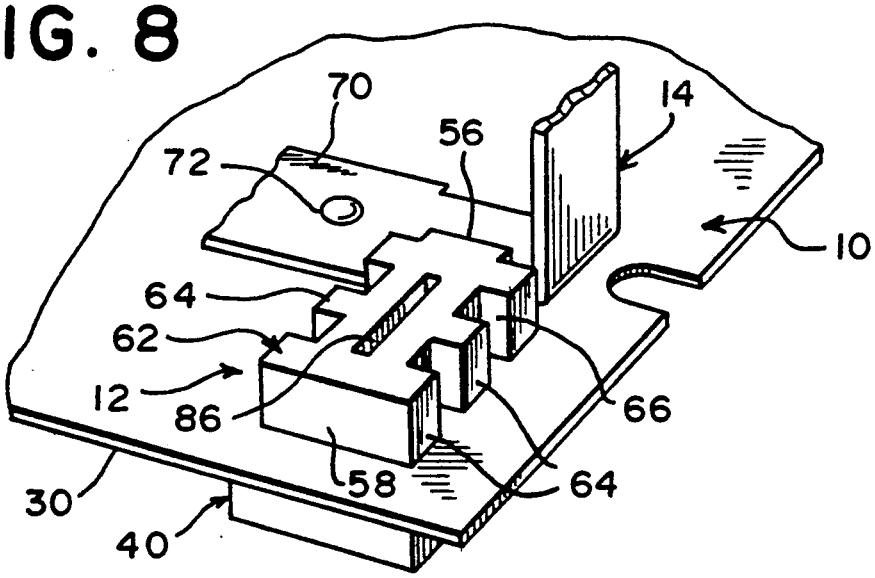
FIG. 8 is a perspective detail of the insulator shifted into its mounted position and locked therein by the rivet secured frame.

Noting the sequential steps of FIGS. 7 and 8, after an extension of the insulator head 62 through the cutout 16, the insulator 12 is shifted longitudinally outward to position the projecting arms 64 on the head 62 in overlying relation to the edge projections or shoulders 34 and 38 of the cutout 16. As illustrated, the first transverse pair of arms 64 adjacent the outer end 58 of the body 54 will, upon a shifting of the insulator 12, overlie the corner projections 38 while the two remaining pairs of transversely aligned arms 64 overlie the cutout projections 34. When so positioned, the insulator is mounted and precluded from direct withdrawal from the mounting plate through the cutout. It is to be appreciated that the height of the neck portion 60, that is the distance between the planar upper surface 50 of the base which engages the undersurface of the mounting plate and the planar undersurfaces 68 of the arms 64 which engage the upper surface of the mounting plate is such whereby while the insulator can slide within the cutout to its mounted position, excess movement between the insulator and the mounting plate is precluded.

As will be noted, at the outer end 58 of the body 54, the neck, head portion and adjacent pair of arms provide a common planar face. This face, and particularly the portion thereof corresponding to the neck 60 defines an abutment surface which, upon engagement with the outer end 28 of the cutout, defines the outer shifted limited of the insulator 12 which in turn ensures a proper positioning of the insulator with the insulator arms overlying the cutout projections 34 and 38.

The laterally aligned pair of arms 64 adjacent the opposite or inner end 56 of the head 62 are slightly longitudinally inwardly offset whereby a slight longitudinal end projection is provided which aligns with and passes upwardly through the end extension in the cutout 16 adjacent the inner end 26 thereof. This slight end projection, as well as the chamfered corners 44 of the base 40 provide both a visual and tactile means for properly orienting the insulator 12 for initial insertion through the cutout 16 both rapidly and with no possibility of error.

After each insulator 12 has been engaged through the corresponding cutout 16 to the opposite sides of the longitudinal centerline 18 of the mounting plate 10, the U-shaped locking frame 14 is mounted. This locking frame 14 includes a crossbar 70 which overlies the planar upper surface of the mounting plate 10 along the centerline 18 thereof and is permanently affixed thereto by rivets 72 engaged through the crossbar and the rivet apertures 24 in the mounting plate. The opposed end portions of the crossbar, respectively along opposite longitudinal edges thereof, engage the inner ends 56 of the heads 62 of the two insulators 12 in the shifted and mounted positions thereof, thereby defining means for locking the two insulators 12 in their mounted positions. In other words, with the locking frame positioned on and riveted to the mounting plate 10, an inward shifting of the insulators 12 to their released positions within the cutouts is precluded. As illustrated, the opposed end portions of the crossbar 70 of the locking frame 14 can be slightly narrower than the central or main body portion of the crossbar.

The locking frame 14 also includes a pair of end uprights 74 integral with and extending upward from the opposed ends of the crossbar 70. These uprights 74, toward the upper portion thereof, include mounting slots 76 which snap lock to vertical projections 78 on the opposed ends of the ceramic or insulative comb 80 which in turn directly receives the exposed coil heating element 82.

Noting FIG. 1, the opposed ends of the heating coil 82 define leads which are secured to terminals 84 which in turn align with and extend through a longitudinally elongate central slot 86 in each insulator 12 for connection to an appropriate source of electrical energy upon installation within a dishwasher or the like.

From the foregoing it will be appreciated that the insulator of the invention, the complementary cutout and the assembly system derived therefrom uniquely combine to provide a support system for an open coil heating element which utilizes minimal components and, through a simple series of assembly steps, is particularly adapted for both quick and error-free assembly. The insulators, when mounted, are positively locked into position against any possibility of movement from their proper mounted positions.

The foregoing is considered illustrative of the principals of the invention, and not as a limitation on the scope of the invention as obvious variations may occur to those skilled in the art.

I claim:

1. A support assembly for an electric heating coil, said assembly including a mounting plate having first and second opposed faces and at least one cutout defined therethrough, and an insulator engageable with said plate through said cutout; said insulator including a head portion selectively passable through said cutout from said first plate face to overlie said second plate face, a base configured to overlie said first plate face and preclude passage of said base through said cutout, and a neck positionable within said cutout and integrally joining said head portion and said base, said cutout having opposed inner and outer ends and opposed sides, said head portion being configured for free passage through said cutout in a first aligned position therewith, said insulator, upon passage of said head portion through said cutout, being longitudinally shiftable toward said outer end of said cutout to a second position with said head portion at least partially overlying said second face of said mounting plate whereby withdrawal of said head portion through said cutout is precluded, said cutout including areas of greater and lesser widths between said opposed sides, said opposed sides of said cutout including alternate recesses and projections to respectively define said areas of greater and lesser widths, said head portion including opposed sides having alternate projecting arms and notches therealong, said arms and notches of said head portion complementing said cutout recesses and projections respectively and freely passing thereby upon alignment therewith in said first aligned position, said projecting arms of said head portion, in said second position, overlying said projections of said cutout, and locking means for fixing said insulator in said second position against longitudinal movement from said second position to said first position.

2. The support assembly of claim 1 wherein said projections and recesses in each cutout side are laterally aligned with the respective recesses and projections of the other cutout side.

3. The support assembly of claim 2 wherein said neck of said insulator, in said second position, engages against said outer end of said cutout, said locking means extending over said inner end of said cutout for engagement against said head portion of an insulator in said second position for retention of said insulator in said second position.

4. The support assembly of claim 3 wherein said mounting plate has two duplicate cutouts defined therein spaced from each other to the opposite sides of a centerline therebetween, the inner end of each cutout being inwardly directed toward said centerline, said cutouts being longitudinally spaced along the centerline, and duplicate insulators engageable within said two cutouts, said locking means, upon engagement and shifting of said two insulators in the respective cutouts, simultaneously engaging and retaining both insulators.

5. The support assembly of claim 4 wherein said locking means comprises an elongate bar extending longitudinally along the centerline and across said inner ends of said two cutouts, and means for affixing said elongate bar to said plate.

6. The support assembly of claim 5 wherein said locking means comprises a support frame including uprights affixed to opposed ends of said elongate bar of engagement therebetween of an electric heating coil and means for mounting said heating coil to said uprights, said insulators including aperture means defined therein for the reception of electrical leads from a mounted heating coil.

7. An open coil heater assembly comprising a mounting plate having first and second faces, a pair of cutouts defined through said mounting plate between said faces, said cutouts being laterally spaced from each other to the opposite sides of a centerline therebetween and longitudinally spaced along said centerline, each cutout having an inner end adjacent said centerline and an outer end remote therefrom, an insulator mounted in each cutout by partial insertion therethrough from said first face of said mounting plate, each insulator including a head portion of a configuration capable of passage through the corresponding cutout in a first aligned position therewith, and a base dimensionally greater than said cutout whereby passage of said base through the corresponding cutout is precluded, each insulator being longitudinally shiftable from said aligned position to a second position toward said outer end of the corresponding cutout, said head portion of each insulator in said second position being dimensionally greater than an aligned portion of said corresponding cutout to preclude retraction of said head portion therethrough, an upright frame extending longitudinally along said centerline and fixed to said second face of said mounting plate, said frame extending across the inner ends of said cutouts and precluding shifting of said insulators away from said second positions, an electric heating coil, means mounting said heating coil on said frame above said mounting plate, said heating coil having opposed ends with terminal means thereon, said insulators including means for receiving said terminal means therethrough.

8. The heater assembly of claim 7 wherein each cutout includes opposed sides extending between the inner and outer ends thereof, said opposed sides having alternating projections and recesses therealong, each head portion of each insulator having opposed edges with alternating arms and notches which in said first aligned position align respectively with the recesses and projections of the corresponding cutout for free passage of said head portion therethrough, said head portion of each insulator in the second shifted position thereof being oriented with the arms thereof overlying said cutout projections.

9. The heater assembly of claim 8 wherein each insulator head portion includes an inner end and an outer end respectively positioned to correspond to the inner and outer ends of the corresponding cutout, each head portion from said inner end to said outer end being of a lesser length than the corresponding cutout from said inner to said outer ends thereof, each insulator in said second shifted position thereof engaging against said outer end of the corresponding cutout to define an abutment for positioning of said insulator in said second shifted position.

10. A method of forming a support assembly for an electric heating coil wherein said assembly includes a mounting plate with a pair of cutouts therein having longitudinally aligned areas of greater and lesser transverse widths, and a pair of insulators wherein said insulators include head portions with extensions engageable solely through said areas of greater width; comprising the steps of positioning each insulator with each head portion extension thereof in alignment with an area of greater width of a corresponding cutout, inserting each head portion through the corresponding cutout, longitudinally shifting each insulator toward a corresponding area of lesser width, each insulator having a neck portion below the head portion freely movable into said area of lesser width, and locking each insulator in the corresponding area of lesser width.

11. The method of claim 10 wherein each insulator is locked in said area of lesser width by positioning a locking bar in engagement with each insulator and fixing said locking bar to said mounting plate.

12. The method of claim 11 including the steps of supporting an electric coil over said mounting plate and engaging opposed terminal end portions of said coil through said insulators.

13. An open coil heater assembly comprising a mounting plate having first and second faces, a pair of cutouts defined through said mounting plate between said faces, said cutouts being laterally spaced from each other to the opposite sides of a line therebetween and longitudinally spaced along said line, each cutout having a first end proximate said line and a second end distal therefrom, an insulator mountable in each cutout by partial insertion therethrough from said first face of said mounting plate, each insulator including a head portion of a configuration capable of passage through the corresponding cutout in a first aligned position therewith, and a base dimensionally greater than said cutout whereby passage of said base through the corresponding cutout is precluded, each insulator being longitudinally shiftable from said aligned position to a second position toward said second end of the corresponding cutout, said head portion of each insulator in said second position being dimensionally greater than an aligned portion of said corresponding cutout to preclude retraction of said head portion therethrough, a frame positionable longitudinally along said line to extend across the first ends of said cutouts and precluding shifting of said insulators away from said second positions, means for fixing said frame to said mounting plate, an electric heating coil, means for mounting said heating coil on said frame above said mounting plate, said heating coil having opposed ends with terminal means thereon, said insulators including means for receiving said terminal means therethrough.

* * * * *

UNITED STATES PATENT AND TRADEMARK OFFICE

CERTIFICATE OF CORRECTION

PATENT NO. : 5,298,723

DATED : March 29, 1994

INVENTOR(S) : James E. Philpot

It is certified that error appears in the above-indentified patent and that said Letters Patent is hereby corrected as shown below:

Column 5, line 68, "an" should be --said--.

Column 6, line 20, "of" (second occurrence) should be --for--.

Signed and Sealed this

Twelfth Day of July, 1994

*Attest:*

*Attesting Officer*

BRUCE LEHMAN

*Commissioner of Patents and Trademarks*